US011047080B2

(12) United States Patent
Kongo

(10) Patent No.: US 11,047,080 B2
(45) Date of Patent: Jun. 29, 2021

(54) EMBROIDERY DATA GENERATOR, EMBROIDERY DATA GENERATION METHOD AND NON-TRANSITORY RECORDING MEDIUM

(71) Applicant: JANOME SEWING MACHINE CO., LTD., Tokyo (JP)

(72) Inventor: Takeshi Kongo, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 154 days.

(21) Appl. No.: 16/449,297

(22) Filed: Jun. 21, 2019

(65) Prior Publication Data

US 2020/0040499 A1 Feb. 6, 2020

(30) Foreign Application Priority Data

Jul. 31, 2018 (JP) ..... JP2018-143751

(51) Int. Cl.
*D05B 19/10* (2006.01)

(52) U.S. Cl.
CPC ..... *D05B 19/10* (2013.01)

(58) Field of Classification Search
CPC ..... D05B 19/02; D05B 19/08; D05B 19/10; D05C 5/00
USPC ..... 700/138
See application file for complete search history.

(56) References Cited

U.S. PATENT DOCUMENTS 5,035,193 A * 7/1991 Hanyu ..... D05B 3/00 112/475.19
5,775,240 A * 7/1998 Hara ..... D05B 19/08 112/102.5
8,219,237 B2 7/2012 Schweizer
2008/0127871 A1* 6/2008 Tashiro ..... D05B 19/08 112/470.01

FOREIGN PATENT DOCUMENTS

JP H01-94890 4/1989

* cited by examiner

*Primary Examiner* — Nathan E Durham
(74) *Attorney, Agent, or Firm* — Nakanishi IP Associates, LLC

(57) ABSTRACT

An embroidery data generator generates embroidery data of a whole pattern of joined pattern-configuration-elements. The embroidery data generator includes a pattern-configuration-element generation section configured to generate the pattern-configuration-elements from array patterns configured from unit patterns and having tapered profiles imparted to end portions of the array patterns, and to place the pattern-configuration-elements so that adjacent of the pattern-configuration-elements are joined to each other at tapered portions having the tapered profile.

10 Claims, 19 Drawing Sheets

EMBROIDERY DATA GENERATOR, EMBROIDERY DATA GENERATION METHOD AND NON-TRANSITORY RECORDING MEDIUM

CROSS REFERENCE TO RELATED APPLICATIONS

This application is based on and claims the benefit of priority to Japanese Patent Application No. 2018-143751 filed on Jul. 31, 2018, the contents of which are hereby incorporated by reference in their entirety.

TECHNICAL FIELD

The present invention relates to an embroidery data generator and an embroidery data generation method and computer program stored in non-transitory recording medium.

BACKGROUND ART

Generally when producing a pattern of a figure such as a polygonal shape by combining sewing patterns using an ordinary sewing machine configured with an amplitude mechanism and a feed mechanism, the initial step is to first draw the figure to be sewn onto fabric.

Next, in order to provide a taper at both ends of a pattern when combining patterns, a taper angle for the start of sewing, a taper angle for the end of sewing, and an approximate number of cycles are set, and test sewing is performed.

Furthermore, a trial and error approach is adopted so as to achieve the target length while increasing or decreasing the number of cycles.

Once the number of cycles has been determined, then real sewing is started along the lines drawn on the fabric, and a product is gradually finished by repeatedly performing test sewing and real sewing.

There is, moreover, technology disclosed that relates to a continuous border sewing machine to augment a regular portion of a predetermined combination pattern (see, for example, Patent Document 1). This technology is related to sewing decorative boarders provided around the periphery of jersey numbers and the like. Supplementary sewing is performed by successively selecting a combination pattern appropriate to the peripheral shape, and by a user operating a presser bar lifter at corner portions and rotating the cloth so as to perform supplementary sewing at portions where there is a turn in direction.

Moreover, a sewing machine is also disclosed that is capable of adjusting a seam width of a sewing pattern during sewing by a user selecting a setting and adjusting parameters and the like (see, for example, Patent Document 2).

RELATED TECHNOLOGY DOCUMENTS

Patent Documents

Patent Document 1: Japanese Patent Application Laid-Open (JP-A) H01-94890

Patent Document 2: U.S. Pat. No. 8,219,237

However, there is an issue with methods employed hitherto in that slight differences arise in the length of sewing due to differences between test sewing pieces and the real fabric, and also overlap or gaps may occur at the join portions due to the angle of taper also not being freely settable.

Namely, there is an issue in that the end result of sewing varies greatly depending on the expertise of the user.

Moreover, in the technology described in Patent Document 1, the user needs to operate the presser bar lifter and rotate the cloth at the corner portions. Moreover, although the continuity of stitching is secured, the issue of overlapping at the corner portions still occurs as before, as illustrated in FIG. 8C of Patent Document 1, and has not been solved thereby.

Moreover, in the technology described in Patent Document 2, due to the way in which a taper is produced being reliant on the user, there is still the issue that the end result of sewing varies greatly depending on the expertise of the user.

SUMMARY OF INVENTION

In consideration of the above circumstances, an object of the present invention is accordingly to provide an embroidery data generator, and an embroidery data generation method and program, that are capable of forming patterns without overlap or gaps occurring at the join portions, irrespective of the expertise of the user.

First Aspect: one or more exemplary embodiments of the present invention provides an embroidery data generator to generate embroidery data of a whole pattern of joined pattern-configuration-elements, the embroidery data generator comprising: a pattern-configuration-element generation section configured to generate the pattern-configuration-elements from array patterns configured from unit patterns and having tapered profiles imparted to end portions of the array patterns, and to place the pattern-configuration-elements so that adjacent of the pattern-configuration-elements are joined to each other at tapered portions having the tapered profile.

Second Aspect: one or more exemplary embodiments of the present invention provides the embroidery data generator, wherein the array patterns are rectangular shaped arrays of the unit patterns.

Third Aspect: one or more exemplary embodiments of the present invention provides the embroidery data generator, further comprising: a whole pattern shape selection section configured to select a shape of the whole pattern; and when determined from the shape of the whole pattern selected by the whole pattern shape selection section that there will be one array pattern adjacent to one end portion of the array pattern, a tapered profile is imparted to the end portion so as to provide one of the tapered portions.

Fourth Aspect: one or more exemplary embodiments of the present invention provides the embroidery data generator, further comprising: a whole pattern shape selection section configured to select a shape of the whole pattern; and when determined from the shape of the whole pattern selected by the whole pattern shape selection section that there will be two array patterns adjacent to one end portion of the array pattern, tapered profiles are imparted to the end portion so as to provide two of the tapered portions.

Fifth Aspect: one or more exemplary embodiments of the present invention provides the embroidery data generator, wherein when widths of the array patterns are the same as each other, the embroidery data generator further comprises: an angle computation section configured to compute from the shape of the whole pattern selected by the whole pattern shape selection section an angle $\theta$ ($0<\theta<\pi$) between the adjacent array patterns, and the pattern-configuration-element generation section produces the tapered portions such that the tapered profile has an angle of θ/2 with respect to a length direction of the array patterns.

Sixth Aspect: one or more exemplary embodiments of the present invention provides the embroidery data generator, wherein when the widths of the array patterns to be joined together are different from each other: the pattern-configuration-element generation section uses simultaneous equations of straight lines leading out from length direction sides of the mutually intersecting array patterns to find two intersection points, and generates the tapered profiles so as to have angles found from a slope of a straight line connecting the two intersection points.

Seventh Aspect: one or more exemplary embodiments of the present invention provides the embroidery data generator, wherein: the pattern-configuration-element generation section produces the tapered profile over a distance range of T=W/tan (θ) from an end of the array pattern, wherein θ is an angle of taper of the array pattern and W is a maximum width of the array pattern.

Eighth Aspect: one or more exemplary embodiments of the present invention provides the embroidery data generator, wherein: when there will be two array patterns adjacent to one end portion of the array pattern, the pattern-configuration-element generation section substitutes W/2 for W, and produces the tapered profiles over a distance range of T=W/2 tan (θ) from the end of the array pattern.

Ninth Aspect: one or more exemplary embodiments of the present invention provides an embroidery data generation method for an embroidery data generator that includes a pattern-configuration-element generation section and is configured to generate embroidery data of a whole pattern of joined pattern-configuration-elements, the embroidery data generation method comprising: the pattern-configuration-element generation section generating the pattern-configuration-elements from array patterns configured from unit patterns and having tapered profiles imparted to end portions of the array patterns, and placing the pattern-configuration-elements so that adjacent of the pattern-configuration-elements are joined to each other at tapered portions having the tapered profile.

Tenth Aspect: one or more exemplary embodiments of the present invention provides a non-transitory recording medium recorded with a program to cause a computer to execute an embroidery data generation method in an embroidery data generator that includes a pattern-configuration-element generation section and is configured to generate embroidery data of a whole pattern of joined pattern-configuration-elements, wherein: the program recorded on the non-transitory recording medium causes the computer to execute the embroidery data generation method in which the pattern-configuration-element generation section generates the pattern-configuration-elements from array patterns configured from unit patterns and having tapered profiles imparted to end portions of the array patterns, and places the pattern-configuration-elements so that adjacent of the pattern-configuration-elements are joined to each other at tapered portions having the tapered profile.

One or more exemplary embodiments of the present invention exhibits the advantageous effect of enabling a pattern to be formed without overlap or gaps occurring at join portions, irrespective of the expertise of the user.

DESCRIPTION OF EMBODIMENTS

A description follows regarding exemplary embodiment of the present invention, with reference to FIG. 1 to FIG. 17.

First Exemplary Embodiment

Description follows regarding an embroidery data generator according to the present exemplary embodiment, with reference to FIG. 1 to FIG. 12.

Note that in the present exemplary embodiment an example will be described in which widths of array patterns to be combined are the same as each other, and these array patterns are employed to produce a whole pattern.

Reference hereinafter to an "array pattern" refers to a pattern, such as that illustrated in FIG. 5, in which one or more unit patterns are arrayed prior to producing a pattern-configuration-element.

Figure 2:
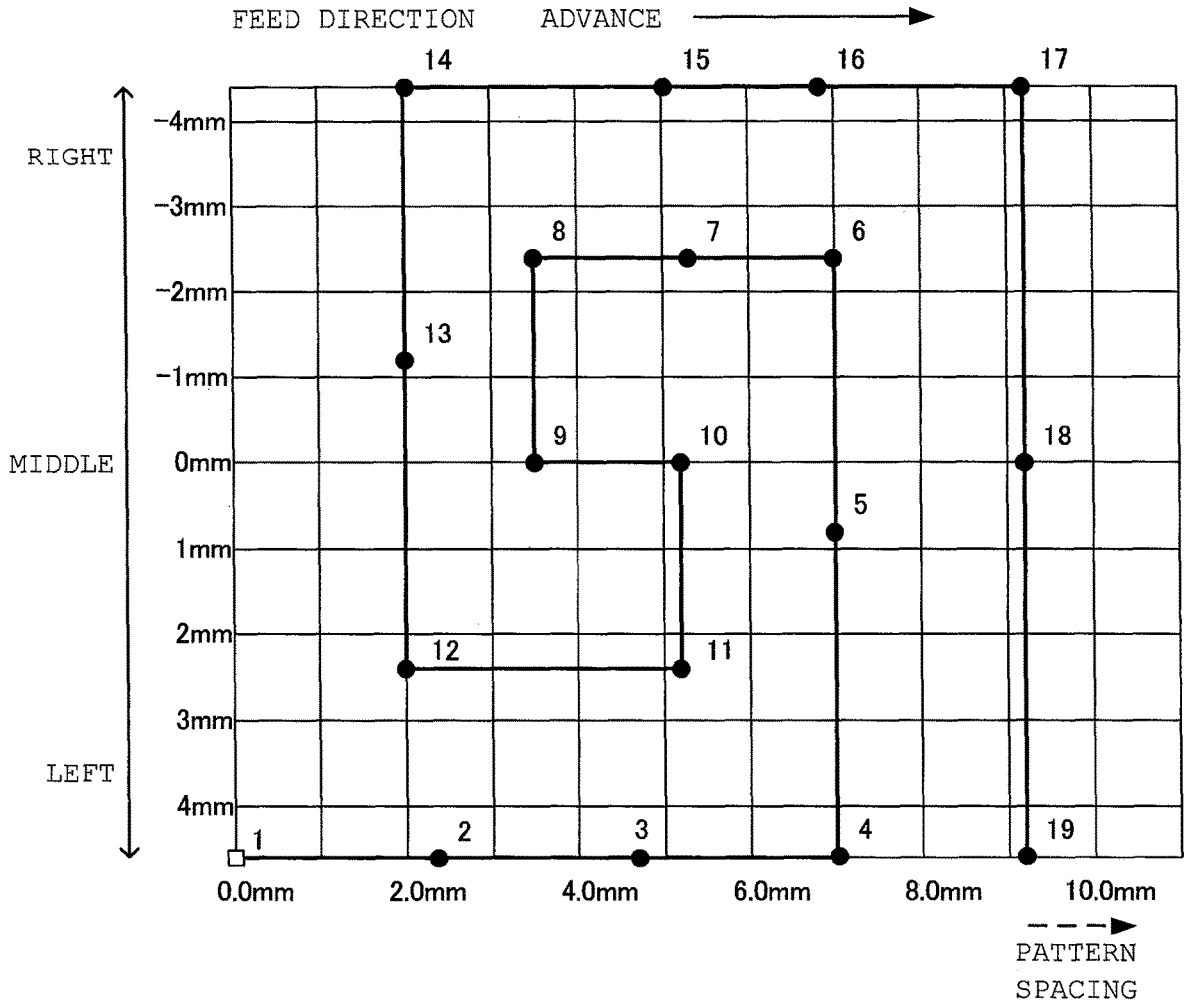
FIG. 2 illustrates needle positions in an embroidery data generator according to the first exemplary embodiment of the present invention.
Figure 3:
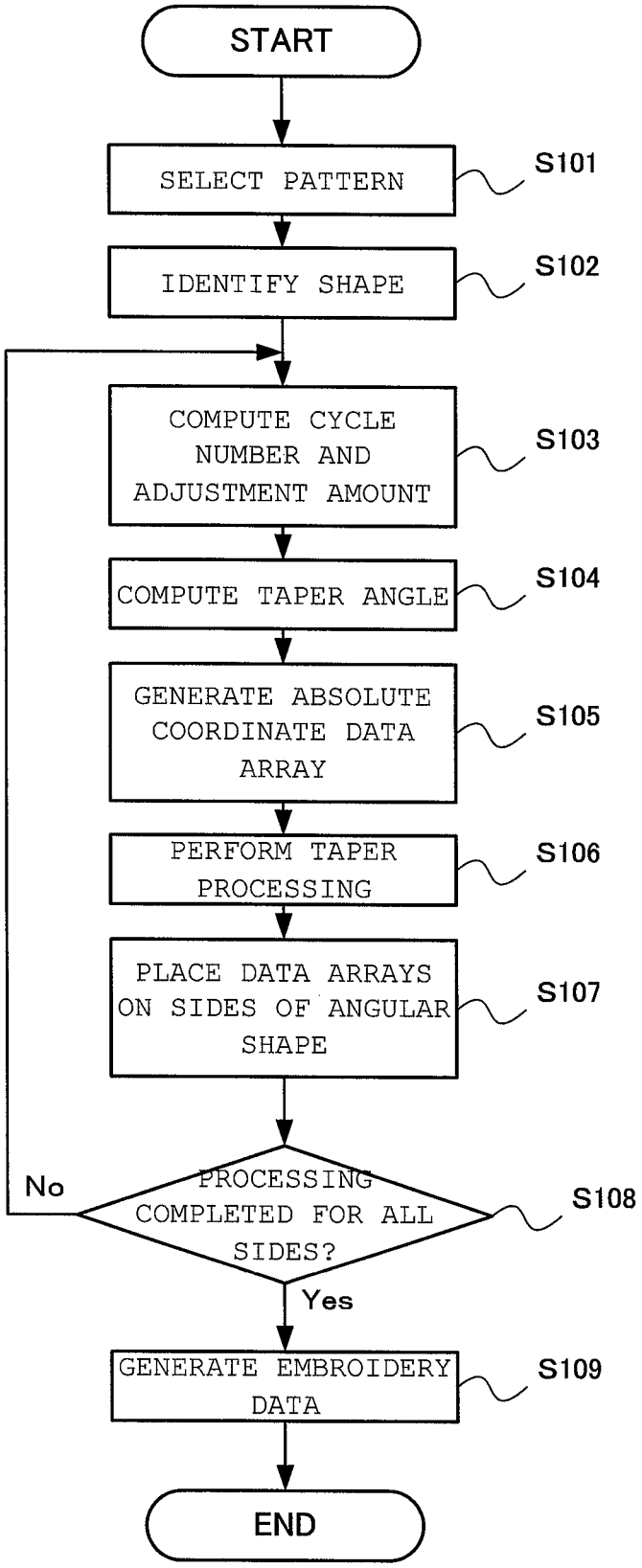
FIG. 3 illustrates processing of an embroidery data generator according to the first exemplary embodiment of the present invention.

Note that "unit pattern" refers to a single geometrical pattern, as illustrated in FIG. 2, representational pattern, or the like and is the pattern of units placed in an array pattern. This may be an ordinary sewing pattern, or may be an embroidery pattern.

Figure 6:
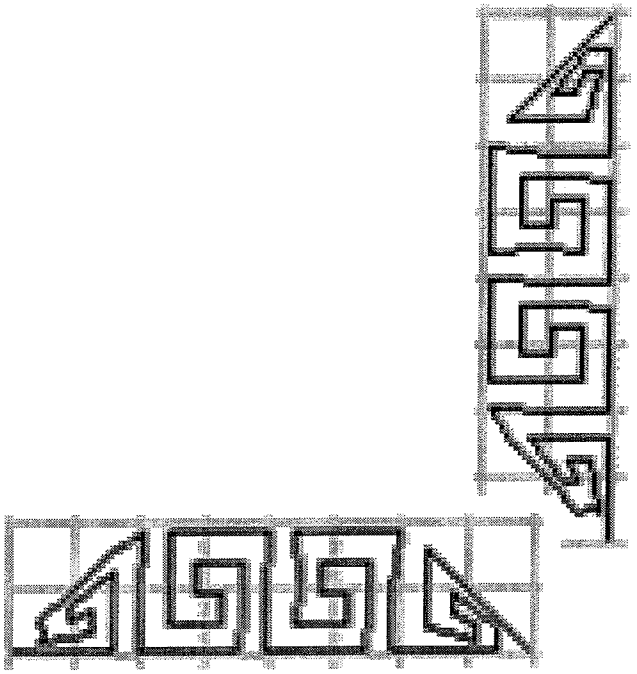
FIG. 6 is a diagram illustrating an example of pattern-configuration-elements when a square shaped pattern with a side length L is generated by an embroidery data generator according to the first exemplary embodiment of the present invention.

Moreover, reference hereinafter to a "pattern-configuration-element" means a pattern, as illustrated in FIG. 6, prior to joining.

Figure 7:
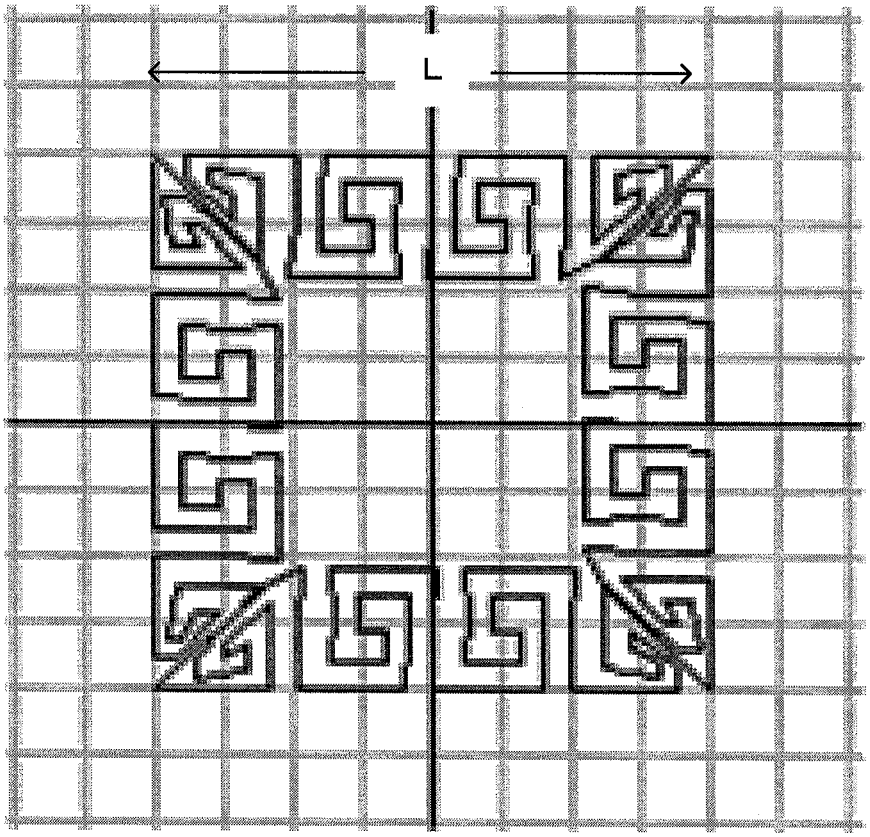
FIG. 7 is a diagram illustrating an example of a whole pattern when a square shaped pattern with a side length L is generated by an embroidery data generator according to the first exemplary embodiment of the present invention.

Moreover, reference hereinafter to a "whole pattern" means a pattern resulting from joining such pattern-configuration-elements together, as illustrated in FIG. 7.

Embroidery Data Generator Electrical Configuration

Figure 1:
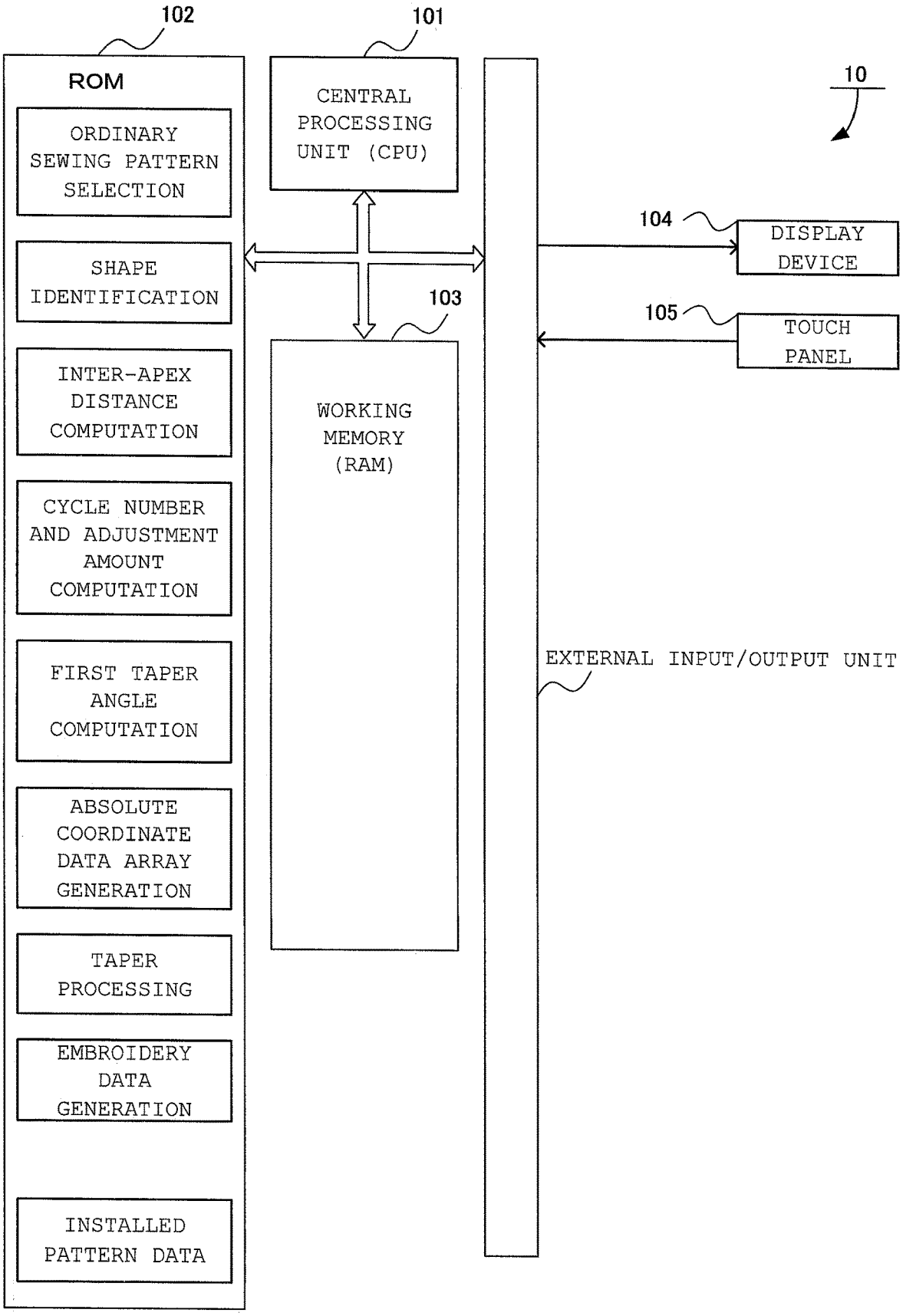
FIG. 1 is a diagram illustrating a configuration of an embroidery data generator according to a first exemplary embodiment of the present invention.

The embroidery data generator 10 according to the present exemplary embodiment is configured including, as illustrated in FIG. 1, a central processing unit (CPU) 101, ROM 102, working memory (RAM) 103, a display device 104, and a touch panel 105.

The CPU 101 controls the overall operation of the embroidery data generator 10 according to a control program stored in the ROM 102.

The CPU 101 is also connected to various devices through an external input/output unit.

The ROM 102 functions as a storage section for storing functional modules.

The RAM 103 temporarily stores prescribed data.

The ROM 102 is stored with data, and functional modules, such as an ordinary sewing pattern selection module, a shape identification module (equivalent to, for example, a whole pattern shape selection section), an inter-apex distance computation module, a cycle number and adjustment amount computation module, a first taper angle computation module (equivalent to, for example, an angle computation section), an absolute coordinate data array generation module, a taper processing module (equivalent to, for example, a pattern-configuration-element generation section), an embroidery data generation module, a loaded pattern data storage area, and the like.

Figure 8:
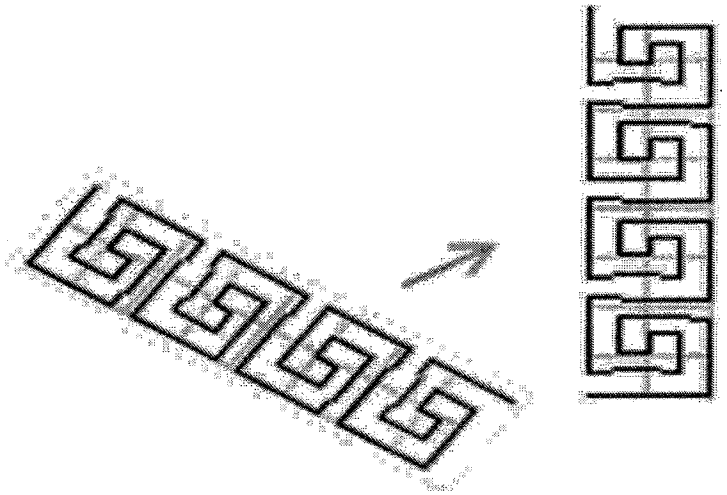
FIG. 8 is an illustration of a procedure in which two array patterns are brought together at a desired angle when performing a drag operation on a GUI screen in an embroidery data generator according to a second exemplary embodiment of the present invention.
Figure 9A:
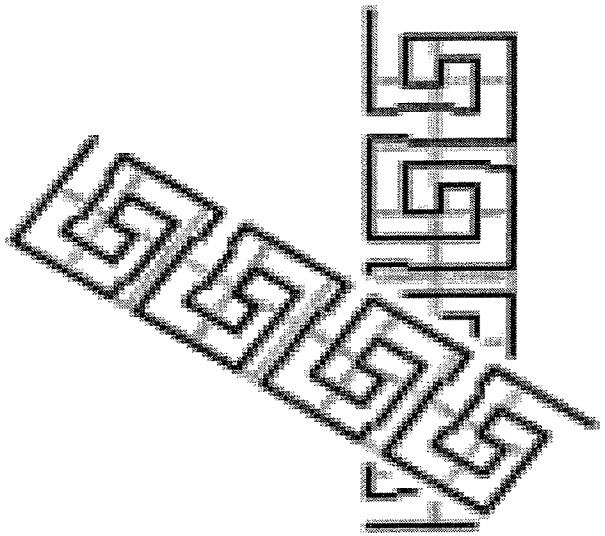
FIGS. 9A and 9B illustrate a procedure in which two array patterns are overlapped at a desired angle and the angle therebetween found when performing a drag operation on a GUI screen in an embroidery data generator according to the second exemplary embodiment of the present invention.
Figure 9B:
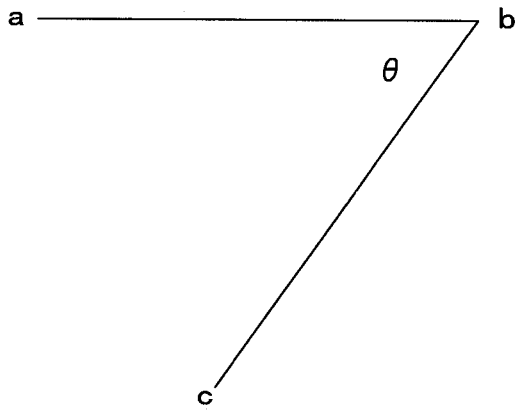
Figure 10:
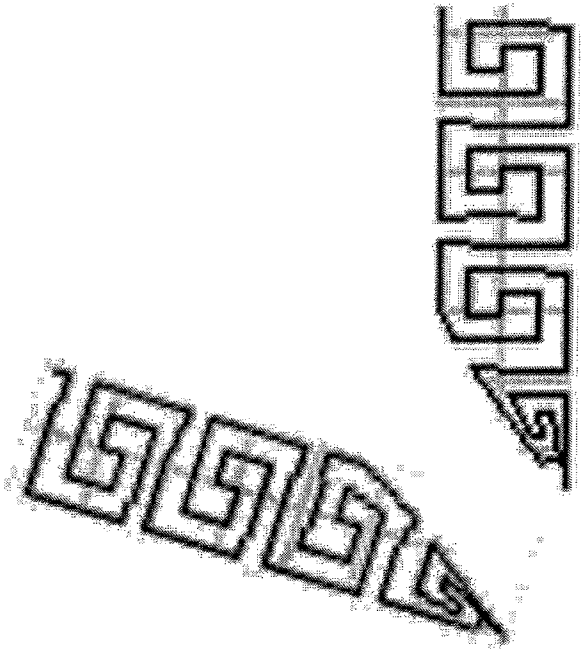
FIG. 10 is an illustration of a procedure for performing taper processing at a found angle on two array patterns and deforming the two array patterns when performing a drag operation on a GUI screen in an embroidery data generator according to the second exemplary embodiment of the present invention.

The display device 104, for example, displays pattern data, and displays placements of array patterns and the like as illustrated in FIG. 8 and FIG. 9, and displays placements of pattern-configuration-elements as illustrated in FIG. 10, and the like.

The display device 104 is electrically connected to the CPU 101 through the external input/output unit.

The touch panel 105, described below, has a multilayer structure superimposed at the upper side of a display face of the display device 104, with the touch panel 105 and the display device 104 unitized into a "display section".

The touch panel 105 is configured by an electrostatic capacitance type of panel, a resistance film type of panel, or the like, and is electrically connected to the CPU 101 through the external input/output unit.

In consideration of the convenience of user operation, the touch panel 105 is disposed exposed at an external portion of the embroidery data generator 10 so as to be operable thereon.

The user is able to operate the touch panel 105 by finger touch while confirming unit pattern selection, placement of pattern-configuration-elements, and the like on the screen.

The CPU 101 sequentially executes a program stored on the ROM 102, and by forming tapers generates embroidery data for a polygonal shape.

More specifically, when the ordinary sewing pattern selection module is started up in the CPU 101, a user selects sewing pattern data configured by amplitude values and feed values such as that illustrated in FIG. 2, and the sewing pattern data is read into the RAM 103.

This enables the length of one cycle of pattern and the length between patterns to be found from the pattern data read into the RAM 103.

Note that although not illustrated in the drawings, the sewing pattern data etc. may be read from an external medium when a USB memory drive is provided.

When the shape identification module is started up, the CPU 101 identifies a whole shape.

When the inter-apex distance computation module is started up, the CPU 101 computes lengths of each side of a polygonal shape formed by connecting each of the apexes together.

When the cycle number and adjustment amount computation module is started up, then from a unit pattern length, a pattern spacing length, and the computed side length, the CPU 101 computes a number of cycles of a unit pattern to be placed in a row along each side, and computes an adjustment amount.

More precisely, magnifications are found under the conditions given below for when the number of cycles is rounded down and for when the number of cycles is rounded up, and the conditions yielding the closest magnification to 1.0 are selected.

(1) The magnification when the number of cycles is rounded down and the length of the unit pattern is expanded so as to exactly fit a designated length.

(2) The magnification when the number of cycles is rounded down and the spacing between unit patterns is expanded so as to exactly fit a designated length.

(3) The magnification when the number of cycles is rounded up and the length of the unit pattern is contracted so as to exactly fit a designated length.

(4) The magnification when the number of cycles is rounded up and the spacing between unit patterns is contracted so as to exactly fit a designated length.

When the taper angle computation module is started up, the CPU 101 finds an angle θ between the two line segments from the slope of the two line segments, and takes an angle of θ/2 as the taper angle.

When the absolute coordinate data array generation module is started up, the CPU 101 uses the ordinary sewing data of FIG. 2, and generates an absolute coordinate data array for needle positions of a continuation of the computed number of cycles at the computed feed magnification.

When the taper processing module is started up, the CPU 101 uses the data array generated by absolute coordinate data array generation module, and makes the magnification smaller and the amplitude narrower for amplitude values on progression toward the end according to position in the feed direction over a length corresponding to the taper angle.

When the embroidery data generation module is started up, the CPU 101 is able to generate embroidery data by repeatedly executing the processing of the taper angle computation module, the absolute coordinate data array generation module, and the taper processing module according to the number of sides, and by placing respective coordinate data arrays in accordance with the whole shape along each of side of the original whole shape, so as to thereby generate embroidery data in which the respective coordinate data arrays are joined with the tapers opposing each other.

When doing so, the sewing machine in receipt of the joined embroidery data drives the sewing mechanism to form seams by outputting information about sewing speed to a sewing machine motor controller.

For example, the corner portions can be linked together by making the seams along a square shape narrow in tapers.

Embroidery Data Generator Processing

Description follows regarding processing of the embroidery data generator according to the present exemplary embodiment, with reference to FIG. 3 to FIG. 11.

The CPU 101 reads the loaded pattern data from the ROM 102, and displays, to the user on the display device 104, pattern data for ordinary sewing configured from amplitude positions and feed amounts.

The user selects a unit pattern by touching, on the touch panel 105, an icon list of the loaded pattern data being displayed on the display device 104 (step S101).

When the selection described above has been performed by the user, the CPU 101 reads the selected unit pattern data into the RAM 103 employed as working memory.

Note that a configuration may also be adopted in which the unit pattern data is read from an external medium when a USB drive interface is provided.

When the selected unit pattern data has been read, the CPU 101 starts up the shape identification module and identifies the whole shape (step S102).

The CPU 101 then starts up the inter-apex distance computation module, and based on coordinates of the apexes and the shape of the polygonal shape, the CPU 101 finds the lengths of each of the sides of the polygonal shape, and computes how many cycles of the unit pattern fit therein.

Moreover, a magnification is also computed so as to place the computed number of cycles of the unit pattern exactly into the length range of each of the sides of the polygonal shape (step S103).

The CPU 101 then starts up the first taper angle computation module, computes an angle formed at the intersection of two adjacent sides, and takes half this angle as the taper angle (step S104).

Figure 4:
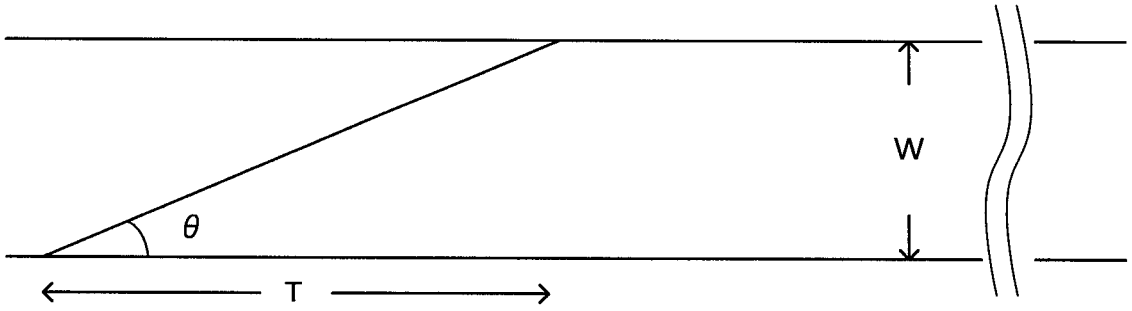
FIG. 4 is a diagram illustrating a relationship between a taper length T, a maximum width W, and a taper angle θ in an embroidery data generator according to the first exemplary embodiment of the present invention.

More specifically, if the polygonal shape is a triangular shape, then the internal angles thereof are 60°, and so the taper angle θ is 30°, as illustrated in FIG. 4.

The CPU 101 then starts up the absolute coordinate data array generation module, converts the read unit pattern data in the RAM 103 into absolute coordinates so as to generate a data array for the found number of cycles in the feed direction (step S105).

The absolute positions are recorded in the feed direction while considering the magnification adjustment.

The CPU 101 starts up the taper processing module, and performs processing to narrow the width of end portions of the absolute coordinate data array generated at step S105 according to position in the feed direction over a length corresponding to the taper angle (step S106).

Note that in the present example, the processing described above is performed for a taper length T, as illustrated in FIG. 4.

The CPU 101 starts up the embroidery data generation module, places the absolute coordinate data arrays formed in the step S106 so to be aligned with the slope of the sides of the polygonal shape, and generates the embroidery data (step S107).

The CPU 101 then determines whether or not the processing of step S107 has been performed for all of the sides (step S108).

Then if the CPU 101 has determined that there are still unprocessed sides (step S108="No"), then processing returns to step S103.

However, if the CPU 101 has determined that the processing of step S107 has been completed for all sides (step S108="Yes"), then embroidery data is generated, and all processing is ended (step S109).

Example 1

Figure 5:
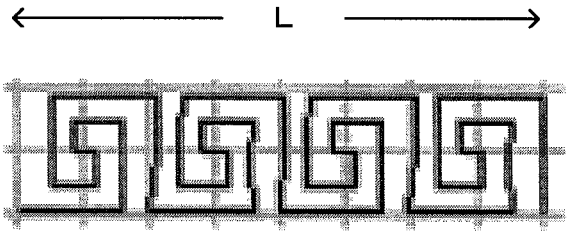
FIG. 5 is a diagram illustrating an example of an array pattern when a square shaped pattern with a side length L is generated by an embroidery data generator according to the first exemplary embodiment of the present invention.

Description follows regarding an Example 1, with reference to FIG. 5 to FIG. 7.

Description in the present example is of an example in which embroidery data joined in a square shape is generated as the polygonal shape.

The user selects a unit pattern by tapping an icon list, on the touch panel 105, of loaded pattern data displayed on the display device 104.

In the present example, an array of the unit pattern selected by the user is the array pattern illustrated in FIG. 5.

The unit pattern data selected by the user is read into the RAM 103.

The whole shape is identified when the selected unit pattern data has been read in.

Then based on the coordinates of the apexes and the shape of the polygonal shape, the length is found for each of the sides of the polygonal shape, and the number of cycles of the unit pattern that will fit therein is computed.

The magnification is also computed so as to place the computed number of cycles of the unit pattern exactly into the length range of each of the sides of the polygonal shape.

In the present example, since the length of one side is L, processing is performed so as to place unit patterns exactly in one side of length L, as illustrated in FIG. 5.

Next, since the polygonal shape in the present example is a square shape, four of the pattern-configuration-elements are placed in a combination, as illustrated in FIG. 7.

When doing so, the taper angle of the portions to be joined is computed so that there is no overlap therebetween, as illustrated in FIG. 6.

In the case of a square shape, the internal angle is 90°, and so the taper angle is 45°.

The unit pattern data that was read is then converted into absolute coordinates in the feed direction for the found number of cycles to generate a data array, the taper processing is executed thereon, and the width of end portions of the produced absolute coordinate data array is narrowed according to position in the feed direction over a length corresponding to the taper angle.

Furthermore, as illustrated in FIG. 7, the absolute coordinate data arrays thus formed are placed so as to match the slope of the sides of the square shape, and the embroidery data is generated.

In the present example, a square shape results from combining four of the pattern-configuration-elements illustrated in FIG. 7, and an ordinary sewing pattern with these four pattern-configuration-element respectively placed along each side is generated as the embroidery data.

Example 2

Description follows regarding an Example 2, with reference to FIG. 8 to FIG. 11.

Note that in the present example an example will be described in which a user generates embroidery data for the desired whole pattern by performing a drag operation while two array patterns are being displayed on a GUI screen.

As illustrated in FIG. 8, two array patterns each having a length L are displayed, and a user brings these two array patterns toward each other on the display screen so as to form the desired whole pattern of polygonal shape.

When the two array patterns are overlapped as illustrated in FIG. 9, an angle θ at the intersection point between a line segment ab and a line segment be can be found from the coordinates of each of the apexes.

This angle θ is an internal angle of the two array patterns in the whole pattern desired by the user, and so θ/2 is the taper angle.

Then, as illustrated in FIG. 10, the read unit pattern data is converted into absolute coordinates in the feed direction for the found number of cycles to generate data arrays, the taper processing is executed, and the width of end portions of the produced absolute coordinate data arrays is narrowed according to position in the feed direction over a length corresponding to the taper angle.

Figure 11:
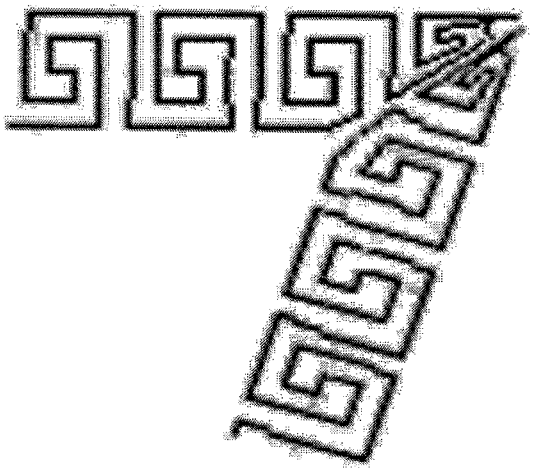
FIG. 11 is an illustration of a procedure for joining two deformed array patterns when performing a drag operation on a GUI screen in an embroidery data generator according to the second exemplary embodiment of the present invention.

Furthermore, a single set of embroidery data is produced by combining the pattern-configuration-elements, as illustrated in FIG. 11.

Modified Example

Explanation follows regarding a modified example, with reference to FIG. 12.

Note that examples have been described in which, when joining in the first exemplary embodiment, Example 1, and Example 2, there will only be one of the pattern-configuration-elements adjacent in the length direction, at the left or right thereof. However, in the present modified example, an example will be described in which, when joining, there will be two pattern-configuration-elements adjacent in the length direction, at the left and right thereof.

In the present modified example, the method of computing the taper angle differs from that of the first exemplary embodiment, Example 1, and Example 2.

Figure 12A:
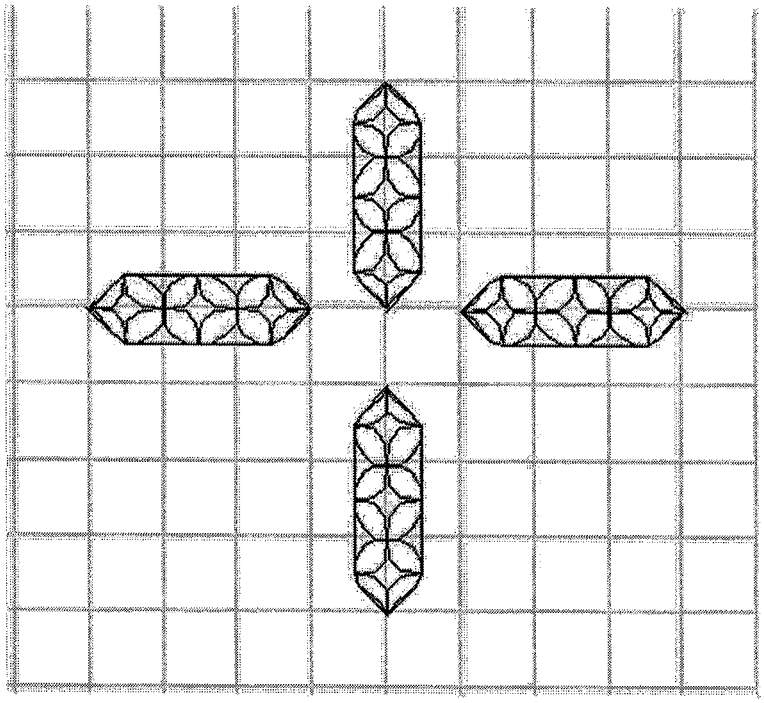
FIGS. 12A and 12B illustrate a procedure for generating an embroidery pattern when there will be two array patterns adjacent to one array pattern in an embroidery data generator according to a modified example of the present invention.

Namely, when the whole shape identified by the shape identification module is a cross-shape, for example, the first taper angle computation module provides two tapered profiles to one end of each of the cross-shapes, so as to be symmetrical about a center line along the length direction of the rectangular shapes, as illustrated in FIG. 12A.

Figure 12B:
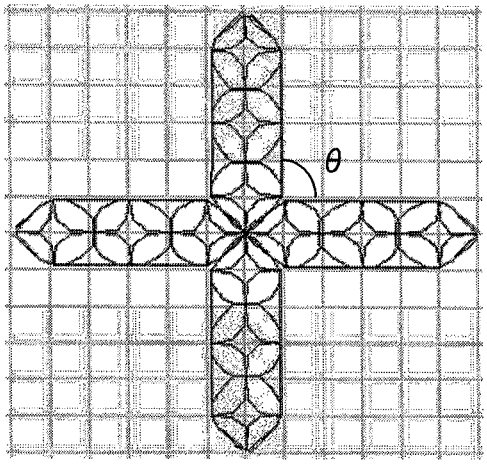

Two of the pattern-configuration-elements are then joined to each one of the pattern-configuration-elements, so as to configure the whole pattern as illustrated in FIG. 12B.

In the example of FIG. 12B, the angle formed between respective pairs of the rectangular shaped array patterns θ=90°. This means that according to the first exemplary embodiment, Example 1, and Example 2 the taper angle is θ/2=45°. However, in the present modified example, two tapered profiles having the taper angle of 45° are provided symmetrically about the center line along the length direction of the rectangular shape.

Thus by forming the tapered profiles in this manner, four of the pattern-configuration-elements are joined together at a single location, thereby enabling a cross-shaped whole pattern to be produced, as illustrated in FIG. 12B.

As described above, in the embroidery data generator 10 of the present exemplary embodiment, the Examples, and the modified example, the pattern-configuration-element generation section generates embroidery data for tapered profiles for the array patterns, and places the pattern-configuration-elements so that the pattern-configuration-elements contact each other at their adjacent tapered profiles.

The pattern-configuration-element generation section accordingly finds taper angles such that the adjacent array patterns will contact each other at the tapered profiles, and automatically generates tapered profile data therefor.

This means that appropriate tapered profile data can be generated automatically without the user performing setting or parameter input.

This enables the whole pattern to be formed without overlap or gaps occurring at the join portions, irrespective of the expertise of the user.

Moreover, in the embroidery data generator 10, the pattern-configuration-element generation section generates pattern-configuration-elements from rectangular shaped array patterns configured by (an array of) unit patterns by imparting tapered profiles to the end portions of these array patterns. The pattern-configuration-element generation section then places these pattern-configuration-elements such adjacent of the pattern-configuration-elements are joined to each other at the tapered portions having the tapered profile (the diagonal line portions in FIG. 4).

Namely, the pattern-configuration-elements are placed such that adjacent pattern-configuration-elements are joined to each other at the tapered portions having the tapered profiles of the pattern-configuration-elements generated in the pattern-configuration-element generation section.

This enables the whole pattern to be formed without overlap or gaps occurring at the join portions, irrespective of the expertise of the user.

Moreover, in the embroidery data generator 10, when there will be one array pattern adjacent to one end portion of a given array pattern due to the shape of the whole pattern selected by the whole pattern shape selection section, the tapered profile of the end portion is provided with a single tapered portion.

Namely, when the user uses the whole pattern shape selection section to select a shape of whole pattern in which there will be one array pattern adjacent to one end portion of the given array pattern, the tapered profile of the end portion is provided with a single tapered portion.

Thus when a user wants to generate a polygonal shaped whole pattern, this enables such a whole pattern to be formed without overlap or gaps occurring at the join portions, irrespective of the expertise of the user.

Moreover, in the embroidery data generator 10, when there will be two array patterns adjacent to one end portion of a given array pattern due to the shape of the whole pattern selected by the whole pattern shape selection section, the tapered profile of the end portion is provided with two tapered portions.

Namely, when the user uses the whole pattern shape selection section to select a shape of whole pattern in which there are two array patterns adjacent to one end portion of the given array pattern, the tapered profile of the end portion is provided with two tapered portions.

Thus when a user wants to generate, for example, a cross-shaped whole pattern, this enables such a whole pattern to be formed without overlap or gaps occurring at the join portions, irrespective of the expertise of the user.

Moreover, in the embroidery data generator 10, the angle computation section computes an angle θ ($0<\theta<\pi$) between adjacent array patterns from the shape of the whole pattern selected by the whole pattern shape selection section when the widths of the respective array patterns are the same as each other. The pattern-configuration-element generation section then generates tapered portions with tapered profiles having an angle of θ/2 with respect to the length direction of the array patterns.

When a user wants to generate, for example, either a polygonal shaped or a cross-shaped whole pattern, this thereby enables such a whole pattern to be formed without overlap or gaps occurring at the join portions, irrespective of the expertise of the user.

Second Exemplary Embodiment

Description follows regarding an embroidery data generator according to the present exemplary embodiment, with reference to FIG. 13 to FIG. 17.

Note that in the present exemplary embodiment an example will be described in which widths of array patterns to be combined are different from each other.

Embroidery Data Generator Electrical Configuration

Figure 13:
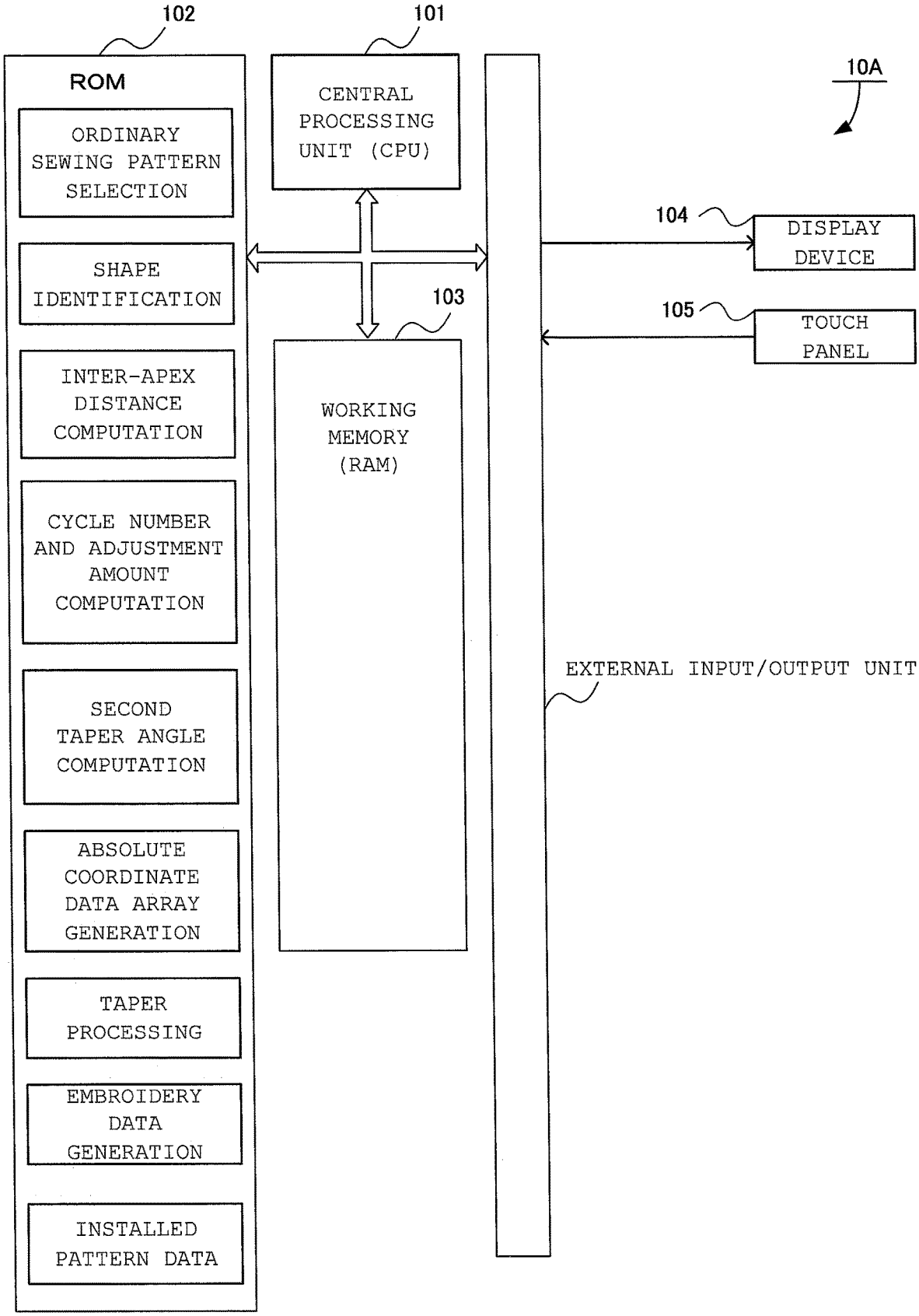
FIG. 13 is an illustration of a configuration of an embroidery data generator according to the second exemplary embodiment of the present invention.

An embroidery data generator 10A according to the present exemplary embodiment, as illustrated in FIG. 13, differs from that of the first exemplary embodiment etc. in that a second taper angle computation module is provided in ROM 102 instead of the first taper angle computation module.

The second taper angle computation module computes a taper angle for two array patterns of different widths.

Description follows regarding specific processing of the second taper angle computation module, with reference to FIG. 14 to FIG. 17.

Figure 15:
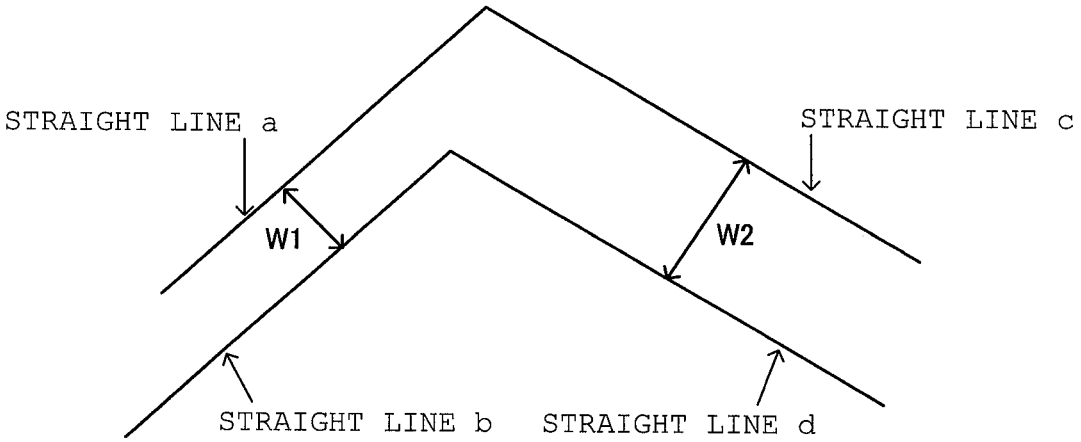
FIG. 15 is a diagram illustrating an example of content of processing to compute taper angles in an embroidery data generator according to the second exemplary embodiment of the present invention.

The example described here is one in which the processing to compute the taper angle of the join portions of pattern-configuration-elements is performed for a case illustrated in FIG. 15 in which an array pattern bounded by a straight line a and a straight line b parallel to the straight line a, intersects with an array pattern bounded by a straight line c and a straight line d parallel to the straight line c.

Straight line a is represented by Equation 1 below, wherein A is the slope of the straight line a, and K is the intercept thereof.

$$y=A\cdot x+K \qquad \text{Equation 1}$$

Straight line b is represented by Equation 2 below, wherein A is the slope of the straight line b, and L is the intercept thereof.

$$y=A\cdot x+L \qquad \text{Equation 2}$$

Intercept L can be found from Equation 3 below, wherein W1 is the width of the array pattern bounded by the straight line a and the straight line b parallel to the straight line a.

$$L=K-W1/\cos(\text{slope of straight line } a) \qquad \text{Equation 3}$$

Straight line c is represented by Equation 4 below, wherein C is the slope of the straight line c, and M is the intercept thereof.

$$y=C\cdot x+M \qquad \text{Equation 4}$$

Straight line d is represented by Equation 5 below, wherein C is the slope of the straight line d, and N is the intercept thereof.

$$y=C\cdot x+N \qquad \text{Equation 5}$$

Intercept N can be found from Equation 6 below, wherein W2 is the width of the array pattern bounded by the straight line c and the straight line d parallel to the straight line c.

$$N=M-W2/\cos(\text{slope of straight line } c) \qquad \text{Equation 6}$$

To find the coordinates of the intersection point between the straight line a and the straight line c, and to find the coordinates of the intersection point between the straight line b and the straight line d, the determinant of Equation 7 is employed to solve Equation 7, yielding Equation 8 and Equation 9.

Note that |V| in Equation 8 and Equation 9 is the magnitude of the inverse matrix.

$$\begin{bmatrix} -A & 1 \\ -C & 1 \end{bmatrix}\begin{bmatrix} x \\ y \end{bmatrix}=\begin{bmatrix} K \\ M \end{bmatrix} \qquad \text{Equation 7}$$

$$\begin{bmatrix} x \\ y \end{bmatrix}=\frac{1}{|V|}\begin{bmatrix} 1 & -1 \\ C & -A \end{bmatrix}\begin{bmatrix} K \\ M \end{bmatrix} \qquad \text{Equation 8}$$

$$|V|=-A\cdot 1-(-C)\cdot 1 \qquad \text{Equation 9}$$

Figure 16:
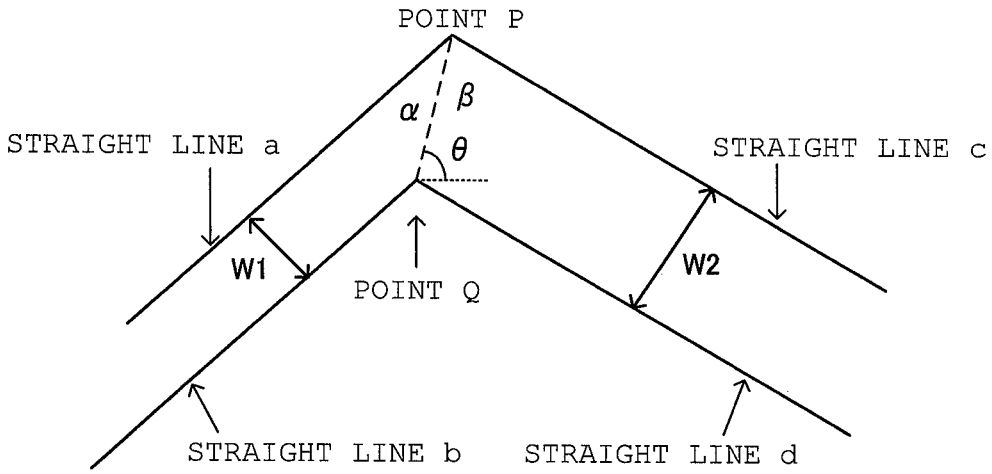
FIG. 16 a diagram illustrating an example of content of processing to compute taper angles in an embroidery data generator according to the second exemplary embodiment of the present invention.

The coordinates of point P in FIG. 16 are found from Equation 8 and Equation 9.

In a similar manner, the coordinates of point Q are found from Equation 10 to Equation 12 below.

$$\begin{bmatrix} -A & 1 \\ -C & 1 \end{bmatrix}\begin{bmatrix} x \\ y \end{bmatrix}=\begin{bmatrix} L \\ N \end{bmatrix} \qquad \text{Equation 10}$$

$$\begin{bmatrix} x \\ y \end{bmatrix}=\frac{1}{|V|}\begin{bmatrix} 1 & -1 \\ C & -A \end{bmatrix}\begin{bmatrix} L \\ N \end{bmatrix} \qquad \text{Equation 11}$$

$$|V|=-A\cdot 1-(-C)\cdot 1 \qquad \text{Equation 12}$$

The slope θ is found using Equation 13 from the coordinates (Px, Py) of the point P and the coordinates (Qx, Qy) of the point Q. The taper angle α is found from the slope of straight line a and the slope θ of straight line PQ.

In a similar manner, the taper angle β is found from the slope of straight line c and the slope θ of straight line PQ.

$$\theta=\tan^{-1}\frac{Py-Qy}{Px-Qx} \qquad \text{Equation 13}$$

Figure 17:
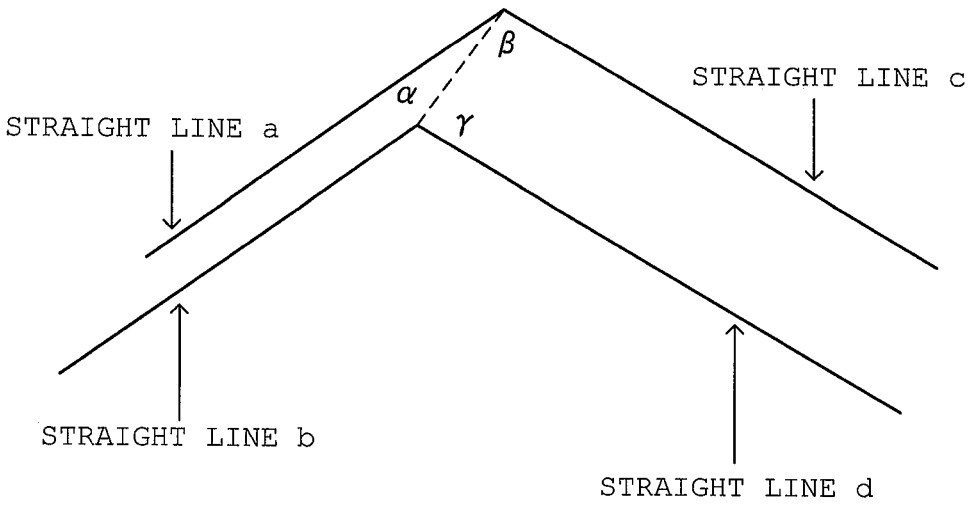
FIG. 17 is a diagram illustrating an example of content of processing to compute taper angles in an embroidery data generator according to the second exemplary embodiment of the present invention.

Note that, depending on the widths of the adjacent array patterns and the angle of intersection therebetween, sometimes the angle β is an obtuse angle, as illustrated in FIG. 17.

In such cases stitch generation processing is switched over from applying a taper on the β side to applying a taper on the γ (=π−β) side.

Embroidery Data Generator Processing

Figure 14:
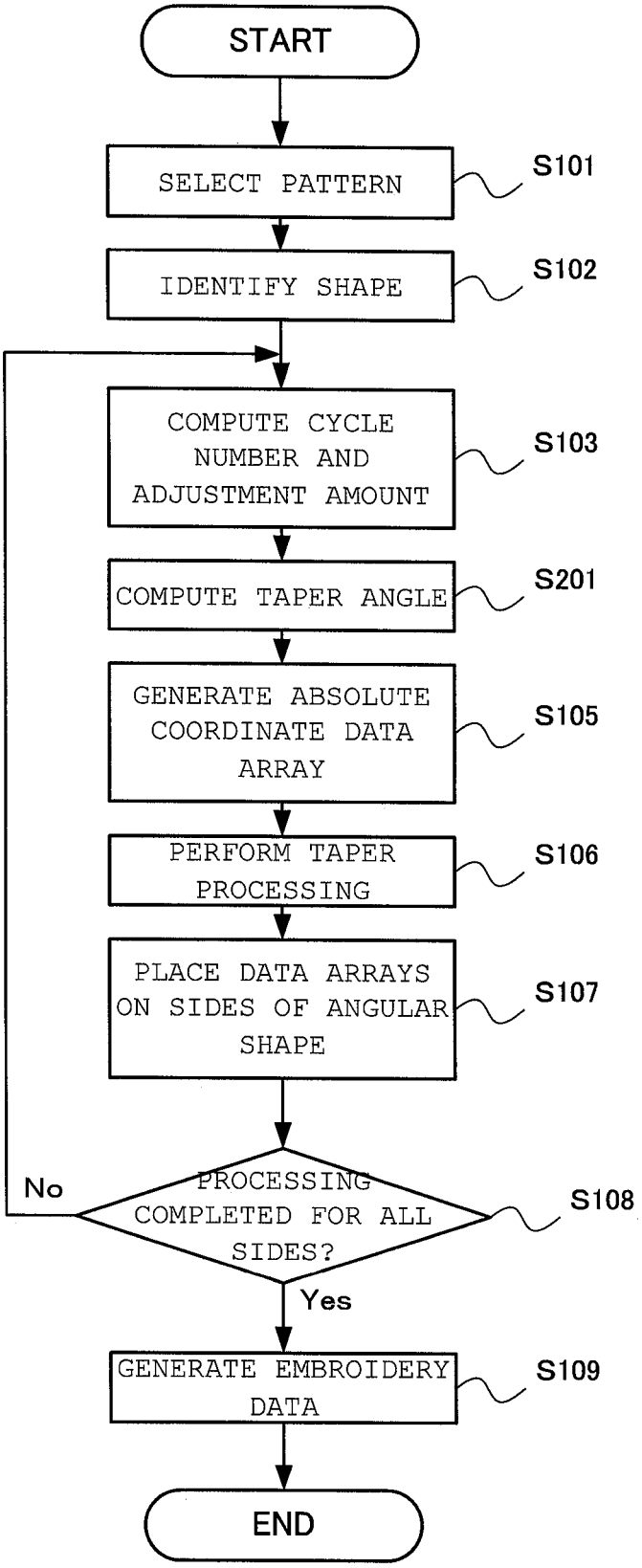
FIG. 14 is a diagram illustrating processing of an embroidery data generator according to the second exemplary embodiment of the present invention.

The processing of the embroidery data generator 10A differs from that of the first exemplary embodiment only in taper angle computation processing (step S201), as illustrated in FIG. 14.

More specifically, the taper angle computation processing in the present exemplary embodiment (step S201) is performed as described above.

As described above, in the embroidery data generator 10A according to the present exemplary embodiment, when the widths of the array patterns to be joined together are different from each other, the pattern-configuration-element generation section uses simultaneous equations of straight lines leading out from the length direction sides of mutually intersecting array patterns to find two intersection points therebetween, and generates tapered profiles having angles found from the slope of a straight line connecting these two intersection points together.

This means that even when the widths of the array patterns differ from each other, a whole pattern can still be formed without overlap or gaps occurring at the join portions, irrespective of the expertise of the user.

Moreover, in the embroidery data generator 10A according to the present exemplary embodiment, the pattern-configuration-element generation section automatically produces the tapered profiles over a distance range of $T=W/\tan(\theta)$ from the end of the given array pattern, wherein the angle of taper of the array pattern is $\theta$, and the maximum width of the array pattern is W (see FIG. 4).

This means that even when the widths of the array patterns differ from each other, a whole pattern can still be formed without overlap or gaps occurring at the join portions, irrespective of the expertise of the user.

Moreover, in the embroidery data generator 10A according to the present exemplary embodiment, when there are two array patterns adjacent to one end portion of an array pattern, the pattern-configuration-element generation section substitutes W/2 for W, and automatically produces the tapered profiles over a distance range of $T=W/2\tan(\theta)$ from the end of the array pattern.

This means that even when the widths of the array patterns differ from each other, a whole pattern can still be formed without overlap or gaps occurring at the join portions, irrespective of the expertise of the user.

Note that processing of the embroidery data generator may be recorded on a recording medium readable by a computer or computer system, with the program recorded on such a recording medium read into the embroidery data generator, and the embroidery data generator of the present invention realized by then executing this processing. The computer system or computer referred to here encompasses an OS as well as hardware such as peripheral devices and the like.

Moreover, "computer system or computer" also encompass a home page provision environment (or display environment) for cases utilizing a world wide web (WWW) system. Moreover, the program referred to above may also be transmitted from one computer system or computer where the program is stored on a storage device or the like, to another computer system or computer via a transfer medium, or via transmission waves through a transfer medium. Reference here to a "transfer medium" to transfer the program encompasses a network (communication network) such as the Internet, and a medium including a function for transferring information such a communications line (coms line) like a telephone line or the like.

Moreover, the program referred to above may be a program that implements part of the functions described above. Furthermore, the functions described above may be implemented in combination with a program already recorded on a computer system or computer, in what is referred to as an incremental file (incremental program).

Although detailed explanation has been given of exemplary embodiments of the present invention with reference to the drawings, specific configurations are not limited to these exemplary embodiments, and encompass any designs or the like not departing from the range of the spirit of the invention. For example, although in the present exemplary embodiment an embroidery data generator has been described that generates embroidery data up to the embroidery data for a whole pattern, a function of the embroidery data generator may be built into a sewing machine or the like.

REFERENCE NUMBERS

10 embroidery data generator
10A embroidery data generator
101 CPU
102 ROM
103 working memory (RAM)
104 display device
105 touch panel

The invention claimed is:

1. An embroidery data generator to generate embroidery data of a whole pattern of joined pattern-configuration-elements, the embroidery data generator comprising:

a pattern-configuration-element generation section configured to generate the pattern-configuration-elements from array patterns configured from unit patterns and having tapered profiles imparted to end portions of the array patterns, and to place the pattern-configuration-elements so that adjacent of the pattern-configuration-elements are joined to each other at tapered portions having the tapered profile, wherein the pattern-configuration-element generation section automatically produces each of the tapered profiles based on calculation of an angle $\theta(0<\theta<\pi)$ between two of the array patterns adjacent to one another.

2. The embroidery data generator of claim 1, wherein the array patterns are rectangular shaped arrays of the unit patterns.

3. The embroidery data generator of claim 1, further comprising:

a whole pattern shape selection section configured to select a shape of the whole pattern; and in the array patterns, when determined from the shape of the whole pattern selected by the whole pattern shape selection section that there will be one array pattern adjacent to one end portion of another array pattern, a tapered profile is imparted to the end portion so as to provide one of the tapered portions.

4. The embroidery data generator of claim 3, wherein when widths of the array patterns are the same as each other, the embroidery data generator further comprises:

an angle computation section configured to compute from the shape of the whole pattern selected by the whole pattern shape selection section an angle $\theta(0<\theta<\pi)$ between the two of the array patterns adjacent one another, and the pattern-configuration-element generation section produces the tapered portions such that the tapered profile has an angle of $\theta/2$ with respect to a length direction of the array patterns.

5. The embroidery data generator of claim 1, further comprising:

a whole pattern shape selection section configured to select a shape of the whole pattern; and in the array patterns, when determined from the shape of the whole pattern selected by the whole pattern shape selection section that there will be two array patterns adjacent to one end portion of another array pattern, tapered profiles are imparted to the end portion so as to provide two of the tapered portions.

6. The embroidery data generator of claim 1, wherein when the widths of the array patterns to be joined together are different from each other:

the pattern-configuration-element generation section uses simultaneous equations of straight lines leading out from length direction sides of mutually intersecting array patterns in the array patterns to find two intersection points, and generates the tapered profiles so as to have angles found from a slope of a straight line connecting the two intersection points.

7. The embroidery data generator of claim 1, wherein:

the pattern-configuration-element generation section produces the tapered profile over a distance range of $T=W/\tan(\theta)$ from an end of one of the array patterns, wherein $\theta$ is an angle of taper of the one of the array patterns and W is a maximum width of the one of the array patterns.

8. The embroidery data generator of claim 7, wherein:

when there will be two array patterns adjacent to one end portion of the one of the array patterns, the pattern-configuration-element generation section substitutes W/2 for W, and produces the tapered profiles over a distance range of $T=W/2\tan(\theta)$ from the end of the one of the array patterns.

9. An embroidery data generation method for an embroidery data generator that includes a pattern-configuration-element generation section and is configured to generate embroidery data of a whole pattern of joined pattern-configuration-elements, the embroidery data generation method comprising:

the pattern-configuration-element generation section generating the pattern-configuration-elements from array patterns configured from unit patterns and having tapered profiles imparted to end portions of the array patterns, and placing the pattern-configuration-elements so that adjacent of the pattern-configuration-elements are joined to each other at tapered portions having the tapered profile, wherein the pattern-configuration-element generation section automatically produces each of the tapered profiles based on calculation of an angle $\theta(0<\theta<\pi)$ between two of the array patterns adjacent to one another.

10. A non-transitory recording medium recorded with a program to cause a computer to execute an embroidery data generation method in an embroidery data generator that includes a pattern-configuration-element generation section and is configured to generate embroidery data of a whole pattern of joined pattern-configuration-elements, wherein:

the program recorded on the non-transitory recording medium causes the computer to execute the embroidery data generation method in which the pattern-configuration-element generation section generates the pattern-configuration-elements from array patterns configured from unit patterns and having tapered profiles imparted to end portions of the array patterns, and places the pattern-configuration-elements so that adjacent of the pattern-configuration-elements are joined to each other at tapered portions having the tapered profile, wherein the program automatically produces each of the tapered profiles based on calculation of an angle $\theta(0<\theta<\pi)$ between two of the array patterns adjacent to one another.

* * * * *